United States Patent [19]

Proud et al.

[11] 4,450,380

[45] May 22, 1984

[54] MULTI-ELECTRODE ARRAY FOR A BEAM MODE FLUORESCENT LAMP

[75] Inventors: Joseph M. Proud, Wellesley Hills; Leslie A. Riseberg, Sudbury; Wojciech W. Byszewski, Arlington; A. Bowman Budinger, Westford, all of Mass.

[73] Assignee: GTE Laboratories Incorporated, Waltham, Mass.

[21] Appl. No.: 336,794

[22] Filed: Jan. 4, 1982

[51] Int. Cl.[3] ..... H01J 1/62; H01J 63/04

[52] U.S. Cl. ..... 313/485; 313/629

[58] Field of Search ..... 313/43, 629, 485

[56] References Cited

U.S. PATENT DOCUMENTS

| | | | |
|---|---|---|---|
| 2,441,863 | 5/1948 | Zabel | 313/629 |
| 2,946,909 | 7/1960 | Morehead | 313/43 |
| 3,013,169 | 12/1961 | Gungle | 313/43 |

*Primary Examiner*—David K. Moore
*Assistant Examiner*—Robert E. Wise

[57] ABSTRACT

The lamp shown herein is a beam mode fluorescent lamp for general lighting applications. The lamp comprises a light transmitting envelope, having a phosphor coating on its inner surface, the envelope encloses a thermionic cathode having a number of segments for emitting electrons, a plurality of anodes for accelerating the electrons and forming a corresponding number of electron beams, and a fill material, such as mercury, which emits ultraviolet radiation upon excitation. The multi-electrode array configuration provides an extended region of electron beam excitation and thereby more visible light. A single power source and pair of connecting conductors perform both cathode heating current and electrode potential difference functions. In addition, this configuration provides for a greater and more complete discharge of the volume within the envelope than single electrode elements. The present invention permits a higher operating voltage, lower power density and a lower operating temperature for the lamp.

10 Claims, 3 Drawing Figures

MULTI-ELECTRODE ARRAY FOR A BEAM MODE FLUORESCENT LAMP

CROSS REFERENCE TO RELATED APPLICATIONS

The present invention is an improvement to copending U.S. patent application Ser. No. 219,564, filed on Dec. 23, 1980, now abandoned, for a "Beam Mode Fluorescent Lamp", assigned to the same assignee. The present invention is also related to pending U.S. patent application Ser. Nos. 336,971; 337,047; and 337,048; and U.S. Pat. No. 4,413,204 and 4,408,141, all assigned to the same assignee.

BACKGROUND OF THE INVENTION (1) Field of the Invention

The present invention pertains to beam mode discharge fluorescent lamps and more particularly to an arrangement for configuring the electrodes within a beam mode discharge fluorescent lamp.

(2) Description of the Prior Art

U.S. patent application Ser. No. 219,564, filed on Dec. 23, 1980, for a "Beam Mode Fluorescent Lamp", and assigned to the same assignee as the present invention, discloses a particular embodiment of a fluorescent lamp suitable for replacing the conventional incandescent bulb. Although incandescent lamps are inexpensive and convenient to use, they are considerably less efficient than fluorescent lamps.

In the above mentioned patent application, a single anode and cathode configuration is shown. This configuration requires three power terminals connecting the cathode and anode to two power sources. In an alternate configuration in this application, a four terminal and two power source configuration is shown in which a heating filament is provided to heat the cathode for the production of electrons.

It is desirable to minimize the number of power sources and connections from the power sources to the anode and cathode of the fluorescent lamp. Such a scheme provides for simpler assembly during manufacture and low end cost.

As pointed out in the above mentioned patent application, the placement and location of the anode and cathode is of critical importance.

One shortcoming of the above mentioned patent application is that, the excitatin of the fill material is incomplete. This situation results in a production of a lesser amount of visible light than otherwise could be produced by the same lamp. Lamp voltage is typically 20–30 volts and requires a base mounted transformer to operate from line voltage.

One of the chief impediments to lamp life and operating efficiency due to light imprisonment is the high operating temperature of the lamp. Another consideration is the variable loading of a single hot cathode.

SUMMARY OF THE INVENTION

Accordingly, it is an object of the present invention to provide a beam mode fluorescent lamp which operates at higher voltages such as that of the conventional AC power line.

It is a further object of the present invention to provide a beam mode fluorescent lamp which provides for a greatly extended region of electron excitation.

It is another object of the present invention to provide a beam mode fluorescent lamp which emits a substantially increased amount of visible light by increasing the spatial extent of electron excitation of the lamp's fill material.

It is yet another object of the present invention to provide an electrode configuration for a beam mode fluorescent lamp which permits a lower cathode temperature for increased lamp life.

The beam mode fluorescent lamp includes a light transmitting envelope enclosing a fill material, which emits ultraviolet radiation upon excitation. A phosphor coating on an inner surface of the envelope emits visible light upon absorption of ultraviolet radiation.

A thermionic cathode for emitting electrons is located within the envelope. The cathode is constructed of a number of cathode segments series connected. The cathode is connected to a single power source by two conductors, one conductor connected to each end of the cathode. These same conductors also serve to support the cathode at a stationary location within said envelope.

A number of anodes are employed. These are an initial, a number of intermediate anodes and a final anode. The initial and final anodes are L-shaped and one is connected to each end of the cathode. The initial anode extends under the first cathode segment and the final anode extends over to the last cathode segment.

One or more intermediate anodes are utilized depending upon the number of cathode segments employed. Each intermediate anode is Z-shaped; the midpoint of the Z-shape is electrically and physically connected to the series connection of the two sequential cathode segments. For each succeeding two cathode segments, another intermediate anode is connected as mentioned. The two horizontal members of the Z-shape are disposed as follows: one over one cathode segment and the second under and parallel to the next sequential cathode segment. The same pattern is followed for each intermediate anode.

Each anode is spaced apart from its corresponding cathode segment by a distance which preferably is less than the electron range in the fill material. The structure of each anode permits acceleration of a corresponding electron beam with minimal collection of primary electrons due to the anode.

The fluorescent lamp includes two pluralities of drift regions within the envelope through which the electron beams drift after passing through their respective anodes. A first plurality of these drift regions is in one direction upward, for example, and the second plurality of these drift regions is in the opposite direction or downward. The up and down directions are only for purposes of explanation, since in a three-space realization of the lamp any configuration will also operate provided that opposite directions are maintained. Electrons in each electron beam collide with atoms of the fill material atoms and emission of ultraviolet radiation and causing ionization of another portion of the fill material atoms and emission of secondary electrons. These secondary electrons cause further emissions of ultraviolet radiation. Due to the greater number of electron beams, the fill material is more completely ionized, resulting in more visible light. The fill material typically includes mercury and a noble gas.

During one-half cycle of an applied AC voltage, via the power source, when the first end of the cathode is positive with respect to the second end of the cathode, each series connection of cathode segments lies at an intermediate potential with respect to the first and second ends of the cathode. As a result, each of the anodes below a corresponding cathode segment will operate to produce an electron beam. This resulting first plurality of electron beams will excite a greater volume of the fill material than a single electrode arrangement.

On the alternate half cycle of the AC voltage, all anodes above corresponding cathode segments will accelerate corresponding electron beam, resulting in a second plurality of electron beams also exciting a greater volume of the fill material than a single electrode arrangement.

A balancing effect will exist in this electrode arrangement, since an increase in discharge current in the first cathode-anode segment will produce a greater voltage drop in the next succeeding segment. This greater voltage drop results in increased filament current and a consequent greater discharge current until the effective resistance of the next sequential segment coincides with that of the first segment. The total current will not increase significantly, if the voltage drop across each segment is in the range of from 20 to 30 volts.

The number of cathode segments and corresponding anodes may be varied, according to the basic principles taught herein. Generally, it is desirable to have a number of cathode segments so that this number multiplied by the voltage required for each segment is greater than the available AC voltage from the power source.

Various shapes of each of the horizontal members of the L-shaped and Z-shaped anodes may be employed in constructing the present invention, however the anodes must not be constructed so as to remove many electrons from the drift regions. The following anode shapes are recommended for the horizontal members but such shapes are not limited to: single wires, planar rectangular wire loops, planar rectangular wire meshes, and slightly curved wire meshes.

Now it can be seen that the use of a large number of beam producing elements, in addition to permitting higher voltage operation, also provides for discharge volumes of greater extent than is possible with single electrode elements. This factor can provide more efficient operation in a fluorescent lamp by establishing conditions of relatively low power density and therefore lower lamp temperature, greater phosphor surface area and an opportunity to minimize resonance radiation imprisonment effects.

DESCRIPTION OF THE PREFERRED EMBODIMENTS

Figure 1:
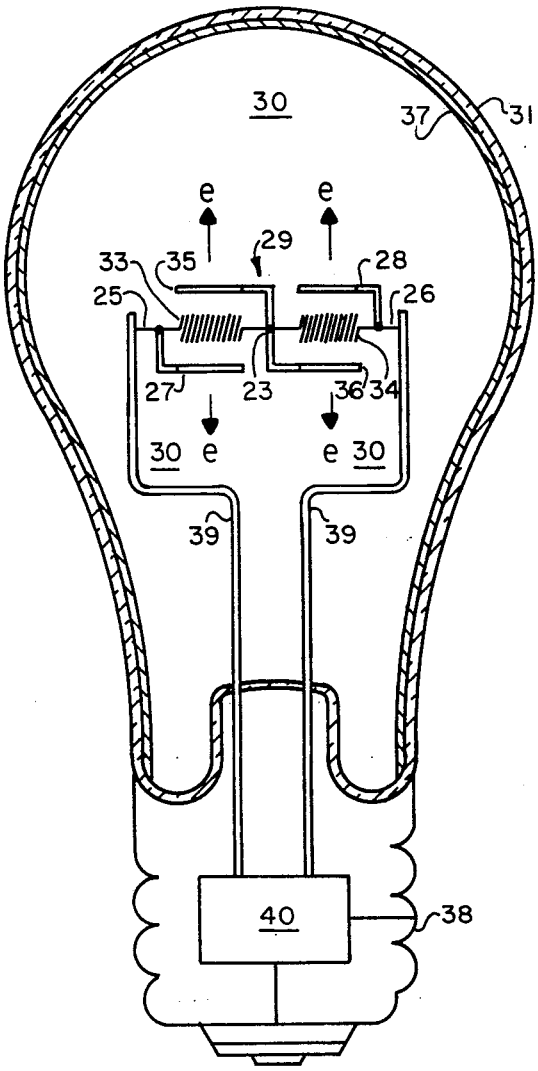
FIG. 1 is a schematic diagram of a multi-electrode array for a beam mode fluorescent lamp embodying the present invention.

Referring to FIG. 1, a multi-electrode beam mode fluorescent lamp according to the present invention is shown. A vacuum type lamp envelope 31 made of a light transmitting substance, such as glass, encloses a discharge volume. The discharge volume contains a fill material which emits ultraviolet radiation upon excitation. A typical fill material includes mercury and a noble gas or mixtures of noble gases. One such noble gas is neon. The inner surface of the lamp envelope 31 has a phosphor coating 37 which emits visible light upon absorption of ultraviolet radiation. Also enclosed within the discharge volume by the lamp envelope 31, are a cathode segments 33 and 34, L-shaped anodes 27 and 28 and Z-shaped anode 29 (comprising two connected L-shaped anodes 35 and 36). The anodes 27, 28, 35, and 36 may have various configurations as described below.

In general, the function of each cathode segment is to emit electrons, while the function of each anode is to accelerate the electrons emitted by the cathode, while collecting only a minimal amount of primary electrons. L-shaped anode 27 is connected to the end 25 of cathode segment 33 and extends under and parallel to cathode segment 33. Cathode segments 33 and 34 connected at common point 23. Another L-shaped anode 28 is connected to the end 26 of cathode segment 34 and extends over and parallel to cathode segment 34.

A Z-shaped anode 29 (which can be thought of as two connected L-shaped anodes 35 and 36 with respective horizontal members) has its midpoint connected electrically to the common point 23 of cathode segments 33 and 34. Anode 35 extends over and parallel to cathode segment 33. Anode 36 extends under and parallel to cathode segment 34. Alternatively, the anodes may be arranged at an angle with respect to the cathode.

Supporting conductors 39 provide for electrical connectin of the single external power supply 40 through the envelope 31 in a vacuum tight seal, as well as providing support for cathode segments 33 and 34 and for anodes 27, 28, and 29. Cathodes 33 and 34 are of a 20 volt thermonic type.

When the electrons beams have passed their respective anodes, they enter into opposing drift regions 30 which extend from the anode to the bounds of the enclosing envelope 31. The lamp further includes a base 38 which is of a conventional type suitable for inserting into an incandescent lamp socket.

During operation, an AC voltage is applied via conductors 39 to thermionic cathodes 33 and 34, thereby providing for a readily available supply of electrons in the discharge space. During the first half of the AC signal, point 25 is positive with respect to point 26 and point 23 is also positive with respect to point 26, as would be the case with any number of cathode segments. As a result, a potential drop exists between points 25 and 23, comprising cathode segment 33, and between points 23 and 26, comprising cathode segment 34. Each anode located below a cathode segment, anodes 27 and 36 will operate to produce an electron beam in the downward direction as shown. Thereby, a larger volume of the fill material will be ionized than would be possible with a single anode configuration. Most of the electrons will pass through anodes 27 and 36 and not collide and subsequently enter their respective drift regions.

During the alternate half of the AC voltage, points 26 and 23 will be positive with respect to point 25. Similarly as described above, anodes 28 and 35 will accelerate electron beams in an upward direction as shown opposite to that for anodes 27 and 36. Once the beams pass the anodes 28 and 35, they will enter their respective upward drift regions.

In the descriptions and claims the directions, up, down, horizontal, and vertical are only for the purpose of explanation since that lamp will operate in any orientation provided that the structural relationships are maintained.

It is to be noted that the cathode heating current and current for developing potential difference between anode and cathode is derived from the same power source 40. Only a single power source providing 20 to 30 volts for each segment and a pair of leads are required for the two functions. As a result, maximum heating of cathode 34 is accomplished since the discharge current does not begin instantly. Thereby, minimim time is required for the discharge to begin. Power source 40 comprises a step-down transformer if required, or may be a direct connection to line voltage.

Self-balancing of current will result in this configuration. If the combined discharge and filament current in the segment composed in part of cathode 33 tends to increase, the voltage drop in this segment decreases and greater voltage drop will occur across the segment containing cathode 34. As a result, the combined filament and discharge current associated with the latter segment will tend to increase thus producing an increase in voltage drop in the first segment containing cathode 33. This tendency to equalize current between segments will occur without increase in the total current if the voltage drop across each segment is in the range of 20 to 30 volts.

The number of cathode segments utilized may be increased to virtually any number. Generally, the number of cathode segments desirable is that number multiplied by thirty which will be greater than the AC voltage avilable.

The pluralities of drift regions, which are generated as a result of multiple cathode segments and corresponding anodes, more completely ionizes the fill material and produces more visible light than a single cathode.

Each of the drift regions preferably has a dimension in the direction of travel of the respective electron beam which is greater than the electron range in the fill material so that the primary electrons in each of said electron beams collide with, ionize, and excite some of the atoms of the fill material in the respective drift region. The excited atoms emit ultraviolet radiation. The secondary electrons collide with and excite other atoms to emit additional ultraviolet radiation.

The spacing of anodes 27, 28, 35, and 36 with respect to cathodes 33 and 34 is such that, the distance may be less than the electron range in the particular fill material to avoid possible current runaway conditions.

Figure 2A:
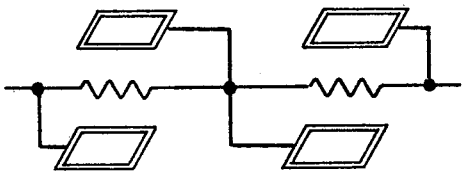
FIG. 2 illustrates various anode configurations which may be employed in realizing the beam mode fluorescent lamp of the present invention.
Figure 2B:
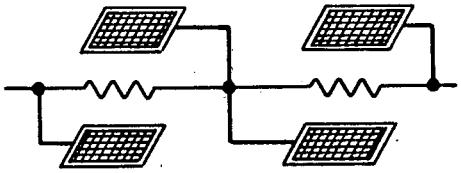
Figure 2C:
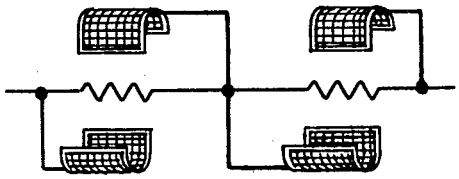

Referring now to FIGS. 2A through 2C, various anode configurations are depicted for use in the present beam mode fluorescent lamp. The anodes are shown somewhat tilted from their actual positions for the purpose of visualization. FIG. 2A illustrates the use of anodes shaped in planar wire rectangular loops. FIG. 2B illustrates the use of anodes in the shape of a planar rectangular wire mesh. FIG. 2C illustrates the use of anodes in the shape of a slightly radiused domed rectangular wire mesh. FIG. 1 illustrates the use of anodes in the shape of wire segments. All of the above configurations are suitable for use in the present invention, although the present invention need not necessarily be limited to these particular configurations.

Figure 3:
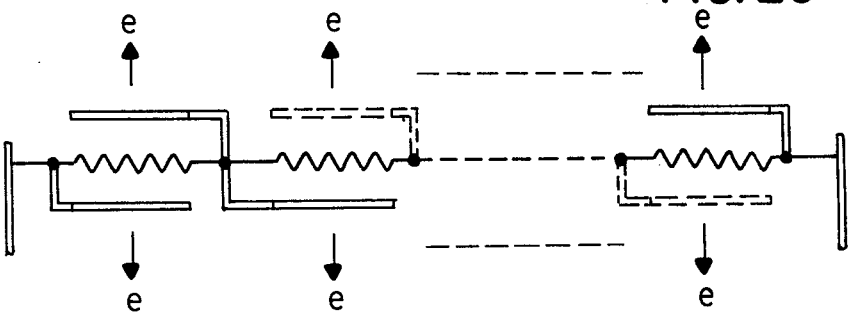
FIG. 3 illustrates that any of the anode configurations of the present invention may include a number of cathode segments and corresponding anodes.

FIG. 3 is a schematic for a large number of cathode segments and corresponding anodes according to the present invention.

The array of active elements can be arranged in many geometries to provide beam excitation in lamps. The array can be configured within a single envelope provided suitable care is taken to prevent runaway arc conditions from developing across regions of greatest voltage drop, e.g., between point 25 and point 26 in FIG. 1. This may be accomplished by means of discharge separating partitions such as discs between said points. Of course, partitioning can be extended to the point that each element in the array occupies a separate discharge volume, the electrical equivalent to connecting N lamps in series.

Although a preferred embodiment of the invention has been illustrated, and that form described in detail, it will be readily apparent to those skilled in the art that various modifications may be made therein, without departing from the spirit of the invention or from the scope of the appended claims.

What is claimed is:

1. A multi-electrode beam mode fluorescent lamp comprising:

a light transmitting envelope enclosing a fill material which emits ultraviolet radiation upon excitation;

a phosphor coating, which emits visible light upon absorption of ultraviolet radiation, on an inner surface of said envelope;

a thermionic cathode having a first and a second end located within said envelope for emitting electrons, said cathode including a plurality of thermionic cathode segments connected in series;

means for coupling AC voltage to said ends of said thermionic cathode;

a plurality of anodes including an initial anode, at least one intermediate anode and a final anode, each of said anodes located within said envelope for accelerating electrons and alternately forming corresponding first and second pluralities of electron beams, each plurality of electron beams in response to a corresponding cycle of said AC voltage applied between said anodes and said cathode, each of said anodes being spaced apart from said cathode by a distance which is approximately less than the electron range in said fill material and having a structure which permits said electron beams to pass thereby;

said initial anode being L-shaped and connected to said first end of said cathode and extending under a first cathode segment of said plurality;

said final anode being L-shaped, said final anode connected to said second end of said cathode and extending opposite to said initial anode a last cathode segment of said plurality;

said intermediate anode being Z-shaped with first and second horizontal members, each of said intermediate anodes connected at a common point to one of said series connections of said cathode segments, said first horizontal member of each of said intermediate anodes extending over one of said series connected cathode segments and said second horizontal member extending opposite to said first horizontal member; and first and second pluralities of drift regions, each drift region located within said envelope through which said first and said second pluralities electron beams drift after passing through said plurality anodes, each of said drift regions having a dimension in the direction of travel of said respective electron beam which is greater than the electron range in said fill material, so that the electrons in each of said electron beams collide with the atoms of said fill material in said respective drift region, thereby causing excitation of a substantial portion of said fill material atoms and emission of ultraviolet radiation and causing ionization of another substantial portion of said fill material atoms and emission of secondary electrons, said secondary electrons causing emission of additional ultraviolet radiation and resulting in a substantial amount of visible light;

said electron beams in said first plurality of drift regions all in one direction and alternately said electron beams in said second plurality of drift regions all in a direction opposite to said electron beams of said first plurality of drift regions.

2. A multi-electrode beam mode fluorescent lamp as claimed in claim 1, wherein said fill material includes mercury and a noble gas.

3. A multi-electrode beam mode fluoresent lamp as claimed in claim 2, wherein said noble gas includes neon.

4. A multi-electrode beam mode fluorescent lamp as defined in claim 1, wherein each of said anodes is in the form of a linear conductive wire segment.

5. A multi-electrode beam mode fluorescent lamp as claimed in claim 1, wherein each of said anodes is in the form of a planar rectangular conductive wire mesh.

6. A multi-electrode beam mode fluorescent lamp as claimed in claim 1, wherein each of said anodes is in the form of a planar rectangular conductive wire loop.

7. A multi-electrode beam mode fluorescent lamp as claimed in claim 1, wherein each of said anodes is in the form of a radiused rectangular conductive wire mesh.

8. A multi-electrode beam mode fluorescent lamp as claimed in claim 1, wherein there is further included a lamp base enclosing said power source, whereby said lamp can be operated directly from AC power.

9. A multi-electrode beam mode fluorescent lamp as claimed in claim 8, wherein said power source provides power for heating each of said cathode segments of said thermionic cathode and simultaneously for providing a potential difference between each of said cathode segments and said anodes.

10. A multi-electrode beam mode fluorescent lamp as claimed in claim 9, wherein said power source provides an AC voltage in the range of from 20 to 30 volts for each cathode segment.

* * * * *